United States Patent [19]

Merrill

[11] 4,181,327

[45] Jan. 1, 1980

[54] ASSEMBLING METHOD

[76] Inventor: Arthur A. Merrill, 25 Commodore Rd., Chappaqua, N.Y. 10514

[21] Appl. No.: 904,896

[22] Filed: May 11, 1978

Related U.S. Application Data

[62] Division of Ser. No. 782,633, Mar. 30, 1977, Pat. No. 4,119,332.

[51] Int. Cl.[2] ..... B42D 1/06

[52] U.S. Cl. ..... 281/25 R; 11/3; 281/21 R; 281/29; 227/155; 227/28

[58] Field of Search ..... 11/1 R, 3; 281/3 R, 281/15 R, 21 R, 25 R, 29; 227/155, 156, 28

[56] References Cited

U.S. PATENT DOCUMENTS

| | | | |
|---|---|---|---|
| 2,057,782 | 10/1936 | La Place | 227/155 X |
| 2,355,737 | 8/1944 | Krehbiel | 281/21 R |
| 2,381,985 | 8/1945 | Robinson | 227/155 X |
| 3,244,436 | 4/1966 | McKowen | 281/29 X |
| 3,310,321 | 3/1967 | Freund | 281/29 X |
| 3,871,227 | 3/1975 | Tidwell, Jr. | 227/155 X |

*Primary Examiner*—Robert L. Spicer, Jr.
*Attorney, Agent, or Firm*—Cameron, Kerkam, Sutton, Stowell & Stowell

[57] ABSTRACT

A process for attaching one or more layers of materials to a base or backing having an anvil in its composition. A backing has incorporated therein an anvil strip of high impact material with formed depressions for clenching staples driven through the layer or layers to be attached. The anvil strip may be a metal strip embedded in the spine of a binder or may be formed by the boundary line of a relatively hard material and a relatively soft material through which a staple or tack may pass and the layers may be a stack of paper or signature sheets.

4 Claims, 10 Drawing Figures

ASSEMBLING METHOD

This is a Division, of application Ser. No. 782,633, filed Mar. 30, 1977, now U.S. Pat. No. 4,119,332.

BACKGROUND OF THE INVENTION

This invention relates to the field of fastening or binding where a first material is stapled into a second material having an anvil in its composition. The invention has particular application in connection with book binding and avoids the use of tools such as sewing machines, adhesive or adhesive applicators; however, the invention is applicable in a variety of fields and industries where it is desired to fasten one material to another. For example, it may be used for fastening automobile interiors, upholstery, internal attachment of panels, etc. Despite its wide application, the invention will be described in connection with book binding wherein several signature sheets are attached in an orderly arrangement to the spine of a binder. However, it should be understood that this description is by way of illustration and should not be construed as a limitation of the invention and its applications.

There are in the prior art a number of book binding articles and methods for assembling sheets of paper. For example, reference may be had to U.S. Pat. Nos. 602,817, issued to Anderson, entitled "Scrap or Sample Book"; 1,324,305, issued to Lutolf, entitled "Art of Bookbinding"; and 1,887,338, issued to Stephens, entitled "Pamphlet and Book Cover". Other art patents related to bookbinding include U.S. Pat. Nos. 180,765 issued to Heyl; 186,791 issued to Bowman; and 2,267,045 issued to Russell.

However, bookbinding as shown in these patents, requires the use of special equipment or multiple operations for assembly. For example, in the patent to Stephens, the sheets are sewn to a backing strip or a reinforcement adhesively united to the innerface of the cover. In the patent of Lutolf, staples are driven by a special machine through a fold in a stack of paper and the ends of the staples are bent inwardly. In the Anderson patent plural sheets of paper are secured to a wood back by brads or nails of sufficient length to be clenched in a separate step. Still another approach is illustrated in the Russell patent wherein staples are driven from opposite ends of the signature sheets.

Each of the bookbinding methods disclosed in the aforementioned prior art patents with the exception of the Russell patent, requires either stitching the binder or bending the ends of a staple or tack over a reinforcing member requiring a separate anvil or clenching device. The use of a separate anvil or clenching device can result in a sudden shift of the sheets of paper resulting in misalignment of the papers and an improperly assembled book or a repeat of the stapling operation. In addition, if sufficient force is not applied to the staple, the staple ends will not clench properly resulting in an inadequately bound book. In the Russell patent, opposing pairs of staples are used. While this avoids the necessity of an anvil, frequent turning of the signature sheets may cause the staples to work loose inasmuch as the ends of the staples are not clamped over the materials.

These problems are overcome in this invention by employing an anvil which is part of the backing or binder. No separate anvil is necessary to align with the stapler, thereby eliminating problems such as shifting paper. Further, fastening by means of this invention is simple and materials can be assembled in a neat permanent fashion, quickly and efficiently. It should be readily apparent that the concepts of the present invention are particularly applicable with abvious advantages when the back of the backing to which materials are to be fastened are inaccessible, e.g., an interior airplane panel or where the back of the material is exposed, but the bent-over points of a staple would look unsightly.

SUMMARY OF THE INVENTION

The present invention resides in a device for making fastening of articles simple and easy, whether it be for upholstery, panels, multiple copy operations or single copy operation either at home, in the office, or in a production line. The binding device of this invention reduces assembly time to a minimum.

In accordance with the present invention, there is embedded in the binder an anvil strip of high impact material for clenching tacks or staples in a single operation. To secure a panel, a sheet or several sheets to a backing, a stapler head is placed over a backing which has embedded therein an anvil strip. Staples are driven through the material to be fastened such that the ends of the staples contact the anvil strip which forces the staple to bend and clench the material.

In the preferred embodiment of the invention, the anvil is molded in the center or spine section of a book cover and has arcuate shaped spaced depressions for clenching tacks or staples. The anvil may be a metal strip or in accordance with an alternate form of the invention may be formed by bonding a hard plastic, which forms the anvil, to a soft plastic to be penetrated by the staple or tack.

DESCRIPTION OF THE PREFERRED EMBODIMENT

Figure 1:
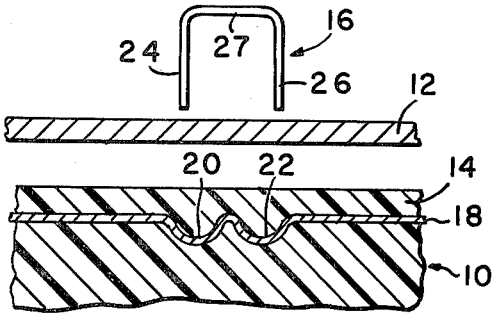
FIG. 1 is a fragmentary side sectional view of the preferred embodiment of this invention prior to assembly.
Figure 2:
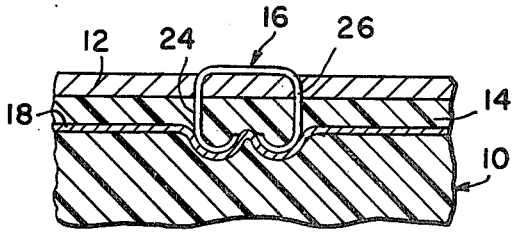
FIG. 2 shows the preferred embodiment of FIG. 1 after the assembly operation.

Referring to FIG. 1, a fastening assembly 10 is shown with a layer or panel of material 12 positioned above a backing 14. A staple 16 is disposed an assembly position which upon insertion into the material 12 binds the material to the backing.

Bookbinding is a term of art for joining sheets of paper in a cover, as used herein defines any joining of paper or sheets to a backing or binder which normally is the cover for the material bound thereto. Thus, material 12 may be one or more signature sheets and backing 14 may take the form of a binder or book cover.

As shown in FIGS. 1–6, binder 14 has molded therein an anvil 18 of high impact material which has been formed with one or more spaced depressions 20 and 22. In the preferred embodiments the depressions are formed in spaced pairs so as to receive ends 24 and 26 of a staple 16. The location of the anvil strip 18 in the binder 14 is such that the depressions 20 and 22 cause the prongs or legs 24 and 26, connected by head portion 27, or staple 16 to clench when forced against the anvil strip 18, as more clearly shown in FIG. 4. In the embodiment illustrated in FIG. 2, the anvil strip 18 is formed of a metal strip such as a steel alloy or similar metal. It is, however advantageous to use a molded high density synthetic hard plastic strip as the anvil strip 18.

Figure 7:
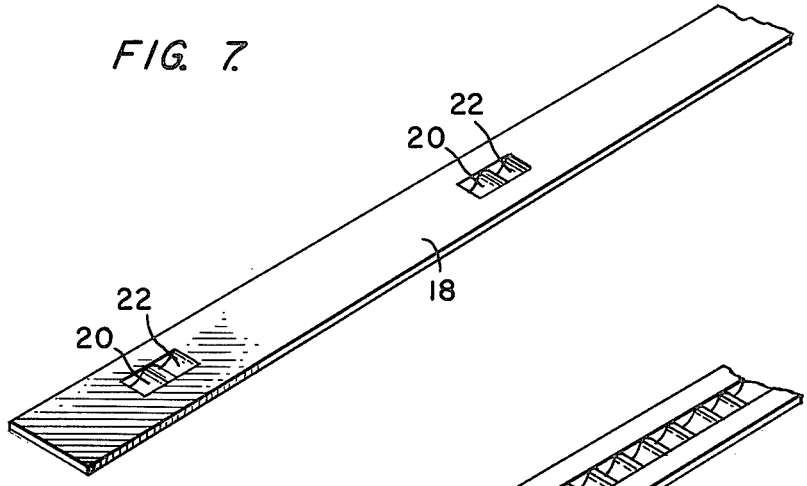
FIG. 7 is an isometric view of a preferred anvil strip of this invention.

The depressions 20 and 22 are preferably arcuate-shaped and pre-formed into anvil strip 18 by stamping or the like, as shown in FIG. 7, where two pairs of spaced depressions are shown. With the depressions spaced apart and the anvil strip molded into the binder 14, the stack of paper 12 may be fastened in two separate areas as with convention book binding methods. However, unless the material of binder 14 is transparent means must be provided for aligning the anvil depressions with the staple.

Figure 8:
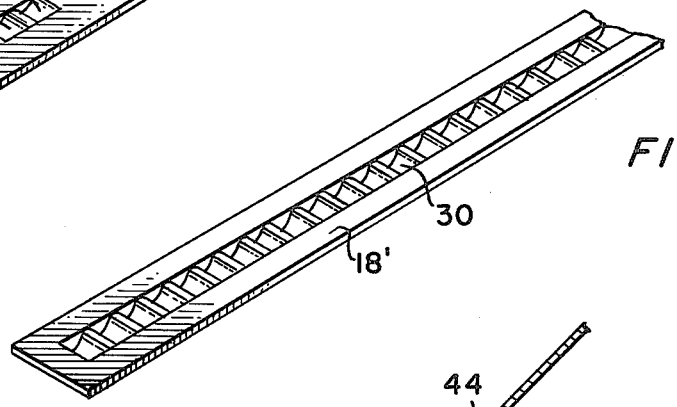
FIG. 8 is an isometric view of an alternative anvil strip of this invention.

Instead of using the anvil strip 18 of FIG. 7, an anvil strip 18′ of FIG. 8 may be used which has a series of adjacent depressions 30 extending the continuous length of the strip. This provides greater latitude in stapling. In using the anvil strip 18′, the stack of paper may be stapled as many times as necessary without undue regard to the location of the depressions 30, whereas, in using the strip 18 the staple must be aligned over the depressions 20 and 22 to insure proper clenching. This, of course, can be done by marking the surface of the binder 14 to indicate the location of the depressions, these markings are not shown.

Figure 10:
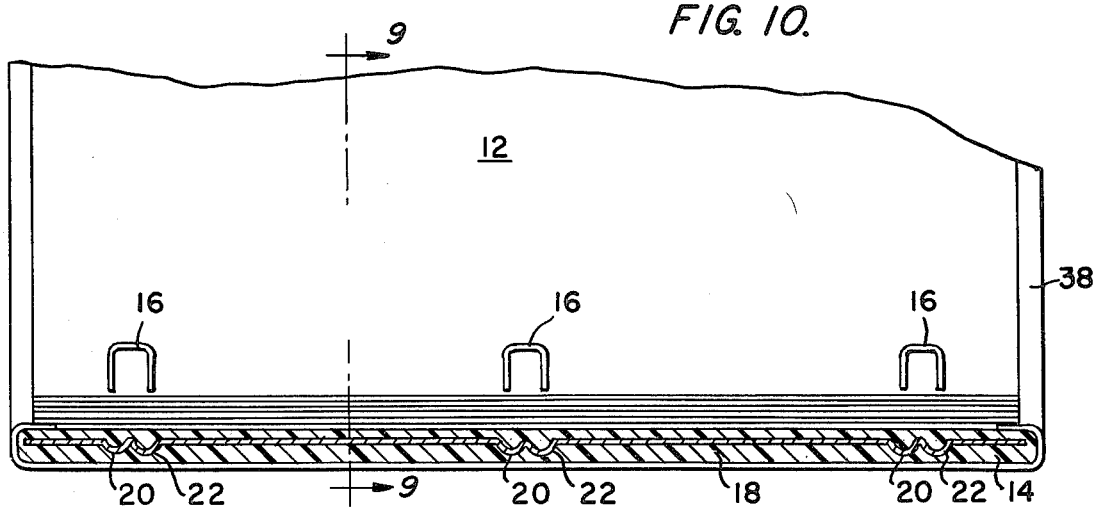
FIG. 10 is a cross-sectional view along the line 10—10 of FIG. 9 in the direction of the arrows.

FIG. 10 illustrates another variation in the anvil strip 18 with three spaced pairs of depressions 20 and 22. Strip 18 is molded into binder 14 and extends from one end of the binder to the other giving support to the binder. As in FIG. 1, the stack of paper 12 is positioned on the binder 14 with staples 16 located above the depressions 20 and 22 such that the prongs 24 and 26 will clench when forced against the curvature of the arcuate shaped depressions.

Figure 9:
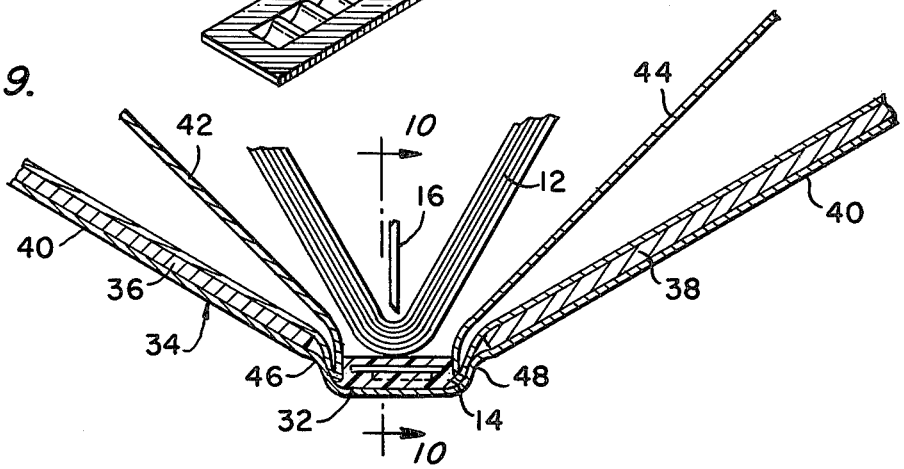
FIG. 9 is a cross-sectional view along the line 9—9 of FIG. 10 of the invention in the direction of the arrows.

The binder 14 includes a rigid spine or center section 32 within which the anvil is formed and a protective cover 34, best shown in FIG. 9, may be provided. The protective cover 34 includes a pair of rigid panels 36 and 38, respectively, which may be wrapped in a flexible protective plastic sheet 40. As shown, binder 14 is bonded to the plastic sheet 40 with the depressions 20 and 22 of an anvil strip 18 properly positioned. Plastic sheet 40 is continuous wrapping around the panels 36 and 38, and bonded in a well known manner to center section 32. In addition, two protective leaves 42 and 44 may be provided with hinge sections 46 and 48 between the center section 32 and panels 36 and 38. While the protective cover 34 forms no part of this invention, it does illustrate how a stack of folded papers may be fastened to a book-type binder in one simple bookbinding operation.

Figure 3:
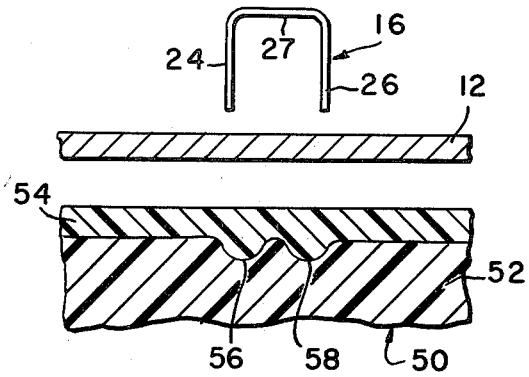
FIG. 3 is a fragmentary side sectional view of an alternative embodiment of this invention prior to assembly.
Figure 4:
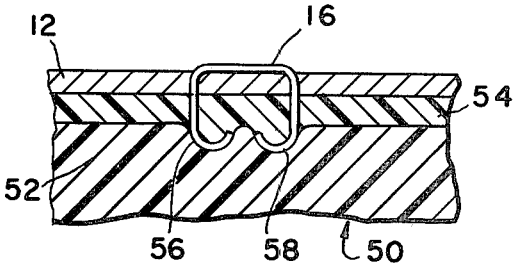
FIG. 4 is a view of the alternate embodiment of FIG. 3 assembled.

Referring now to FIGS. 3 and 4, an alternative embodiment of the binder construction is shown where binder 50 consists of a non-penetrable rigid synthetic plastic anvil strip 52 of high impact material bonded to a durable synthetic plastic strip 54. Strip 54 is softer than strip 52 and is capable of being pierced by a staple or tack. The anvil strip 52 has molded therein depressions 56 and 58 similar to the arcuate shaped depressions of anvil 18 of FIG. 7. Of course, anvil strip 52 may have a series of continuous depressions 30 similar to FIG. 8. Located above the binder 50, in FIG. 3, is a stack of paper 12 and a staple 16. As can be seen in FIG. 4, the staple 16 will clench when forced against the arcuate shaped depressions 56 and 58 securing the paper to binder 50.

Figure 5:
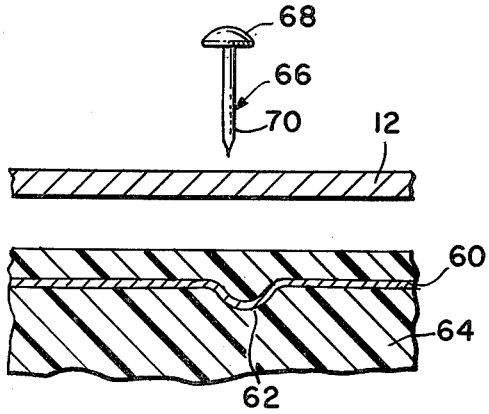
FIG. 5 is a fragmentary side sectional view of still another embodiment of this invention prior to assembly.
Figure 6:
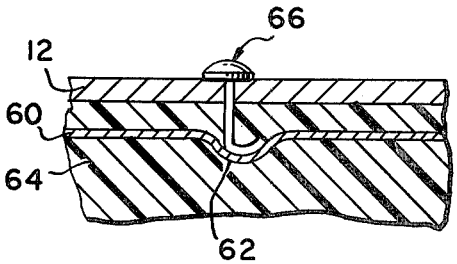
FIG. 6 is a view of the embodiment of FIG. 5 assembled.

Still another embodiment of the invention is shown in FIGS. 5 and 6 where a high impact anvil strip 60 has a single depression 62. The anvil strip 60 is molded into a binder 64 similar to the construction of FIG. 1, or may be of hard plastic material as shown in FIGS. 3 and 4. Positioned above the binder 64 is a stack of paper with a tack 66 having a head 68 and a leg 70 in position to be forced into contact with the arcuate shaped depression 62 clenching the staple 66, as shown in FIG. 6.

In each of the embodiments, binding is effected by forcing the tack or staple through the stack of paper and part way through the binder, causing the ends of the tack or staple to come in contact with the arcuate shaped depression or depressions of the anvil strip. The prong or prongs of the tack or staple are forced to follow the curvature of the depression until the tack or staple head is pressed against the stack of paper and the prong or prongs have clenched the paper as in FIGS. 2, 4 and 6.

It should be apparent that the binders 10 and 60 of FIGS. 1 and 5, respectively, are of durable synthetic plastic which is capable of being pierced by a staple or tack. The present available thermoplastics such as polyethylene, polypropylene and vinyl resins exhibit these qualities. However, there are no doubt other synthetic plastics and binder materials which will work equally well.

Throughout this discussion the anvil strip has been referred to as being molded in a binder. It should be understood that the anvil strip could also be embedded, bonded or incorporated in or to a binder such as, for example, a pressed cardboard binder. Since the invention in its simplest form relates to an anvil strip permanently located in or to a binder, it is not intended that the invention be limited to a single type of binder material or to a specific bonding of the anvil strip and the binder. Likewise, the anvil may be formed by the boundary line between a hard and soft plastic layer as shown in FIGS. 3 and 4.

I claim:

1. A method of assembling one or more sheets of material to a backing comprising: forming an anvil strip of high impact material in the backing, placing the material to be assembled over the binder containing the anvil strip, and forcing at least one fastener through the sheets into surface contact with the high impact material and causing the fastener to clench, thereby securing the material to the binder.

2. A method of assemblying as set forth in claim 1 further including forming depressions in the anvil strip and forcing the ends of the fastener into surface contact at the depression.

3. A method of assembling as set forth in claim 1 wherein said anvil strip is formed by molding a spine member in the backing.

4. A method of assembling as set forth in claim 1 wherein said anvil strip is formed by embedding in said spine member a metal strip.

* * * * *